US009259957B2

(12) United States Patent
Arbili et al.

(10) Patent No.: US 9,259,957 B2
(45) Date of Patent: Feb. 16, 2016

(54) COMBINATION BINDING AND PERFORATING ASSEMBLY

(71) Applicants: Shlomo Arbili, Herzliya (IL); Shachar Arbili, Herzliya (IL)

(72) Inventors: Shlomo Arbili, Herzliya (IL); Shachar Arbili, Herzliya (IL)

(73) Assignees: Shachar Arbili, Herzliya (IL); Guy Arbili, Herzliya (IL); Tal Arbili, Herzliya (IL)

( * ) Notice: Subject to any disclaimer, the term of this patent is extended or adjusted under 35 U.S.C. 154(b) by 0 days.

(21) Appl. No.: 14/436,643

(22) PCT Filed: Oct. 18, 2012

(86) PCT No.: PCT/IL2012/050413

§ 371 (c)(1),
(2) Date: Apr. 17, 2015

(87) PCT Pub. No.: WO2014/061008

PCT Pub. Date: Apr. 24, 2014

(65) Prior Publication Data

US 2015/0283848 A1 Oct. 8, 2015

(51) Int. Cl.

| | |
|---|---|
| ***B42F 3/04*** | (2006.01) |
| ***B42F 13/40*** | (2006.01) |
| ***B26F 1/14*** | (2006.01) |

(52) U.S. Cl.

CPC ... *B42F 3/04* (2013.01); *B26F 1/14* (2013.01); *B42F 13/404* (2013.01)

(58) Field of Classification Search

CPC ..... B42F 13/404
USPC ..... 402/1
See application file for complete search history.

(56) References Cited

U.S. PATENT DOCUMENTS

| | | | |
|---|---|---|---|
| 453,396 A | 6/1891 | Hobbs | |
| 465,258 A | 12/1891 | Gildemyer | |

(Continued)

FOREIGN PATENT DOCUMENTS

| | | | | |
|---|---|---|---|---|
| DE | 368462 C * | 2/1923 | ..... | B42F 13/404 |
| DE | 2751359 A1 * | 5/1979 | ..... | B42F 13/404 |

(Continued)

OTHER PUBLICATIONS

The International Preliminary Report on Patentability for PCT/IL2012/050413, mailed Feb. 10, 2015.

(Continued)

*Primary Examiner* — Kyle Grabowski
(74) *Attorney, Agent, or Firm* — McDonnell Boehnen Hulbert & Berghoff LLP

(57) ABSTRACT

A combination binding and perforation assembly, which includes a base portion, binding rings, perforating rods, guiding plates, a wall portion, a perforation slot, and a lever. The binding rings protrude from the base portion. Each perforating rod is coupled with a respective binding ring via a respective connector. The perforation slot is defined by a gap between the guiding plates and wall portion, which is disposed at an edge of the base portion. The lever is coupled with the binding rings, and can be manually raised and lowered. When the lever is raised, the binding rings open and the perforating rods advance toward the perforation slot to perforate at least one paper sheet inserted in the perforation slot. When the lever is lowered, the binding rings close and the perforating rods retract from the perforation slot. The perforated sheet can then be inserted into the binding rings through the perforations.

10 Claims, 8 Drawing Sheets

(56) References Cited

U.S. PATENT DOCUMENTS

| | | | | | |
|---|---|---|---|---|---|
| 606,508 | A | * | 6/1898 | Boykin | B42F 13/404 402/1 |
| 1,080,022 | A | | 12/1913 | Safro et al. | |
| 1,623,824 | A | * | 4/1927 | Bondeson | B42F 13/404 402/1 |
| 3,349,774 | A | * | 10/1967 | Ryan | B42F 13/404 402/1 |
| 4,749,297 | A | * | 6/1988 | Roy | B42F 13/404 402/1 |
| 5,273,370 | A | * | 12/1993 | Bland | B42F 13/404 402/1 |

FOREIGN PATENT DOCUMENTS

| | | | | | |
|---|---|---|---|---|---|
| DE | 4331707 | A1 | * | 3/1995 | B42F 13/404 |
| DE | 102011001419 | A1 | * | 9/2012 | B42F 13/404 |
| WO | WO 9104871 | A1 | * | 4/1991 | B42F 13/404 |
| WO | 2004052658 | A1 | | 6/2004 | |

OTHER PUBLICATIONS

The International Search Report (ISR) for PCT/IL2012/050413, mailed Feb. 17, 2013.

* cited by examiner

COMBINATION BINDING AND PERFORATING ASSEMBLY

CROSS-REFERENCE TO RELATED APPLICATION

This application is a U.S. national phase of International Application No. PCT/IL2012/050413, filed on Oct. 18, 2012, which is hereby incorporated by reference in its entirety.

FIELD OF THE DISCLOSED TECHNIQUE

The disclosed technique generally relates to office supply products, and more particularly, to binders and perforators.

BACKGROUND OF THE DISCLOSED TECHNIQUE

A binder is used to hold together a collection of loose sheets of paper, such as office documents and files, for organized storage. A binder is generally composed of a folder or cover and a binding mechanism that binds the collected pages and facilitates the addition and removal of the pages. Binding mechanisms may include: clips, lever clips, compression bars, latches, binding rings, lever arches, and clamps. Clips and lever clips operate by applying spring pressure on the collected pages, where the pages need not be modified or adapted in any way to enable their binding. Opening the clip to release the applied pressure allows for appending new pages or the removal of existing pages. Other types of binding mechanisms require the pages to be perforated beforehand, most notably with binding rings, in which the rings pass through the holes in the pages to bind them together. Binding rings are found in ring binders, such as the common three-ring binder which is widely used in North America. Binders come in many forms, shapes and sizes. Binders may be adapted to collect only certain types or sizes of paper (e.g., Letter size, Legal size, A4, and the like), and may include a variable number of binding elements (e.g., two-ring binders, three-ring binders, and the like). Many binders may also include additional features or accessories, such as pockets or cases for holding various writing utensils and other office supplies.

A perforator, also known as a hole puncher or a paper puncher, is a device used to perforate or form holes in a sheet of paper, to enable the paper to be collected into a binder. A perforator usually includes some type of lever that is maneuvered to force at least one bladed cylinder through at least one sheet of paper. The perforator may also include guides that are utilized to align the paper prior to its perforation, to ensure that the holes are set at the desired locations (i.e., to define the margin and separation distances). The perforator may also include some type of container for collecting the perforations (i.e., the punched paper fragments). Perforators also come in many forms, shapes and sizes. Similarly, perforators may be adapted to perforate only certain types or sizes of paper, may be adapted to perforate through a limited number of pages simultaneously (e.g., up to 20 pages, up to 40 pages, and the like), and may include variable number of perforating elements (e.g., two-hole punchers, three-hole punchers, and the like).

Various assemblies known in the art are adapted to combine the functionality of a binder with the functionality of a perforator. One such example can be found in French Patent No. 462,887 to Demignot, entitled: "Perfectionment à la commande des poinçons de perforateurs pouvant s'adapter à toutes les mécaniques de classeurs àlevier". Another example is disclosed by German Patent No. 1,129,455 to Seyffer, entitled "Aufreihvorrichtung für Briefordner mit einer Lochvorrichtung".

U.S. Pat. No. 1,623,824 to Bondeson et al., entitled: "Combined Punch and File", discloses a device adapted to form holes in index cars and also file the index cards. The device includes a base, vertical pins, inverted U-shaped members, a pair of dies, and a pair of hollow posts. The vertical pins are arranged on the base to form a file. The dies are mounted in recesses at the rear of the base, behind respective vertical pins, and the posts are arranged directly over respective dies. The inverted U-shaped member extends from a vertical pin at one end and through a hollow post at the other end. The lower end of the U-shaped member arm, together with the respective die below, forms a punch, operative to punch hole in index cards placed directly over the dies, by pressing down on the U-shaped member. An arm of the U-shaped member may be disengaged from the upper end of the respective pin, enabling the punched cards to be placed onto the pins for filing.

U.S. Pat. No. 6,705,793 to Wyant, entitled "Binder with Hole Punch", is directed to a binder for receiving and retaining loose papers. The binder includes a cover, a binding mechanism, and a hole punch mechanism. The binding mechanism is coupled to the inner surface of the cover at the center, and the hole punch mechanism is coupled to the inner surface of the cover at an outer edge. The binding mechanism may include three openable binding rings evenly spaced apart. The hole punch mechanism includes a movable handle having a set of protrusions on a lower surface, and a base having a set of recesses aligned with the protrusions on an upper surface. A paper is placed between the base and opened handle, and then the handle is closed so that the protrusions meet the respective recesses, thereby punching a set of holes in the paper. The protrusions and recesses are arranged so that the spacing of the holes corresponds to the spacing of the binding rings. The binder may further include a receptacle with a lid at an opposite outer edge of the inner surface of the cover, for holding loose items.

G.B. Patent No. 07491 to Witte et al, entitled "Improvements in Loose-leaf Binders", is directed to a loose-leaf binder combined with a perforator and with yokes associated with file pins. The yokes and the perforator are simultaneously movable by means of a lever. The yokes are fixed to short vertical rods terminating in punches. The rods are connected to each other by a plate that is bent to form a channel. The lever is pivoted to a vertical supporting plate, and includes at one end a roller bevelled to fit the channel. The punches are movable along sockets in the supporting plate. When the lever is raised, the yokes are opened and the punches are retracted away from the plate. When the lever is lowered, the yokes are closed and the punches are depressed against the plate to perforate a document.

European Patent No. 1,985,422 to MAPED, entitled "Paper punch with centering device", discloses a punch that has two piercers movably mounted relative to a base, and a pallet shaped activation lever for simultaneously displacing the piercers relative to the base. Symmetrical notches are provided at a longitudinal rear edge of the base for positioning the base relative to rings of a binder, such that the base is applied through exterior in a predetermined position against the rings. A center distance of the rings corresponds to a predetermined center distance of the piercers.

U.S. Pat. No. 4,656,907 to Hymmen, entitled "Paper Punch", is directed to a hand-operated paper punch formed with molded parts which interfit for easy and rapid assembly and disassembly. A handle hooks under a wall of the base. Depressing the handle forces downward a transverse bar recessed to accept the upper ends of the male punch elements, which are spring-biased to travel with the transverse bar. The punch elements reciprocate within a die bar detachably connected to the base. The die bar is formed with a throat for insertion of papers to be punched. The front edge of the base is formed with a transverse groove to accept a male binder element during assembly of a book comprised of the punched paper.

PCT International Application Publication No. WO 2007/129103 to Kaushal, entitled "File", discloses a file for storage of paper, comprising a front face and a rear face connected along a spine edge, a retention means for paper sheets upstanding from the rear face, and a flap attached to a free edge of the front face opposed to the spine edge. The inner faces of the flap and the front face have cooperative means, such as a pair of opposed rigid plates, defining a hole punch for paper sheets.

SUMMARY OF THE DISCLOSED TECHNIQUE

In accordance with one aspect of the disclosed technique, there is thus provided a combination binding and perforation assembly. The assembly includes a base portion, a plurality of binding rings, a plurality of perforating rods, a plurality of guiding plates, a wall portion, a perforation slot, and a lever. The binding rings protrude from the base portion. Each perforating rod is disposed adjacent to and coupled with a respective binding ring via a respective connector. Each guiding plate is disposed around and at an end of a respective perforating rod, where the guiding plate surface is substantially perpendicular to the base portion surface. The wall portion is disposed at an edge of the base portion, such that the wall portion surface is substantially perpendicular to the base portion surface and substantially parallel to the surfaces of the guiding plates. The perforation slot is defined by a gap between the guiding plates and the wall portion. The lever is coupled with the binding rings. The binding rings bind together a plurality of perforated paper sheets. The perforating rods perforate paper sheets. The guiding plates guide and support the perforating rods. The lever can be manually raised and lowered. When the lever is raised, the binding rings open and the perforating rods advance toward the perforation slot to perforate at least one paper sheet that is inserted in the perforation slot. When the lever is lowered, the binding rings close and the perforating rods retract from the perforation slot. The distance between the perforations produced in the perforated paper sheet substantially corresponds to the distance between the binding rings, enabling the perforated paper sheet to be inserted into the binding rings through the perforations. The assembly may include a bar, coupled with the binding rings and with the lever, and disposed laterally across the base portion. The connector may be a circular link inserted through an aperture in a respective perforating rod and inserted through an aperture in a respective binding ring, thereby coupling the perforating rod with the binding ring. The assembly may further include a container, defined by the wall portion and an additional container wall portion on an opposite side, forming an enclosed compartment between them. The container collects the perforation remains produced after the paper sheet is perforated. The wall portion may include a plurality of holes opposite each of the perforating rods, such that the perforating rods propel the perforation remains into the container upon perforation. The container may include a container cover, which may be positioned onto and removed from the container. The container may be attachable to and detachable from the wall portion. The assembly may include any number of binding rings and corresponding perforating rods, such as two of each, or three of each.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing a ring binder integrated with a perforator in a single assembly. The assembly includes perforator rods adapted to perforate or punch holes into a sheet of paper to be retained by binding rings disposed adjacent to the perforator rods. By maneuvering a single lever, the perforation and binding operations are controlled simultaneously by activating/deactivating the perforator rods while opening/closing the binding rings, allowing the paper to be perforated and the perforated paper to be inserted onto, or removed from, the binding rings.

Figure 1A:
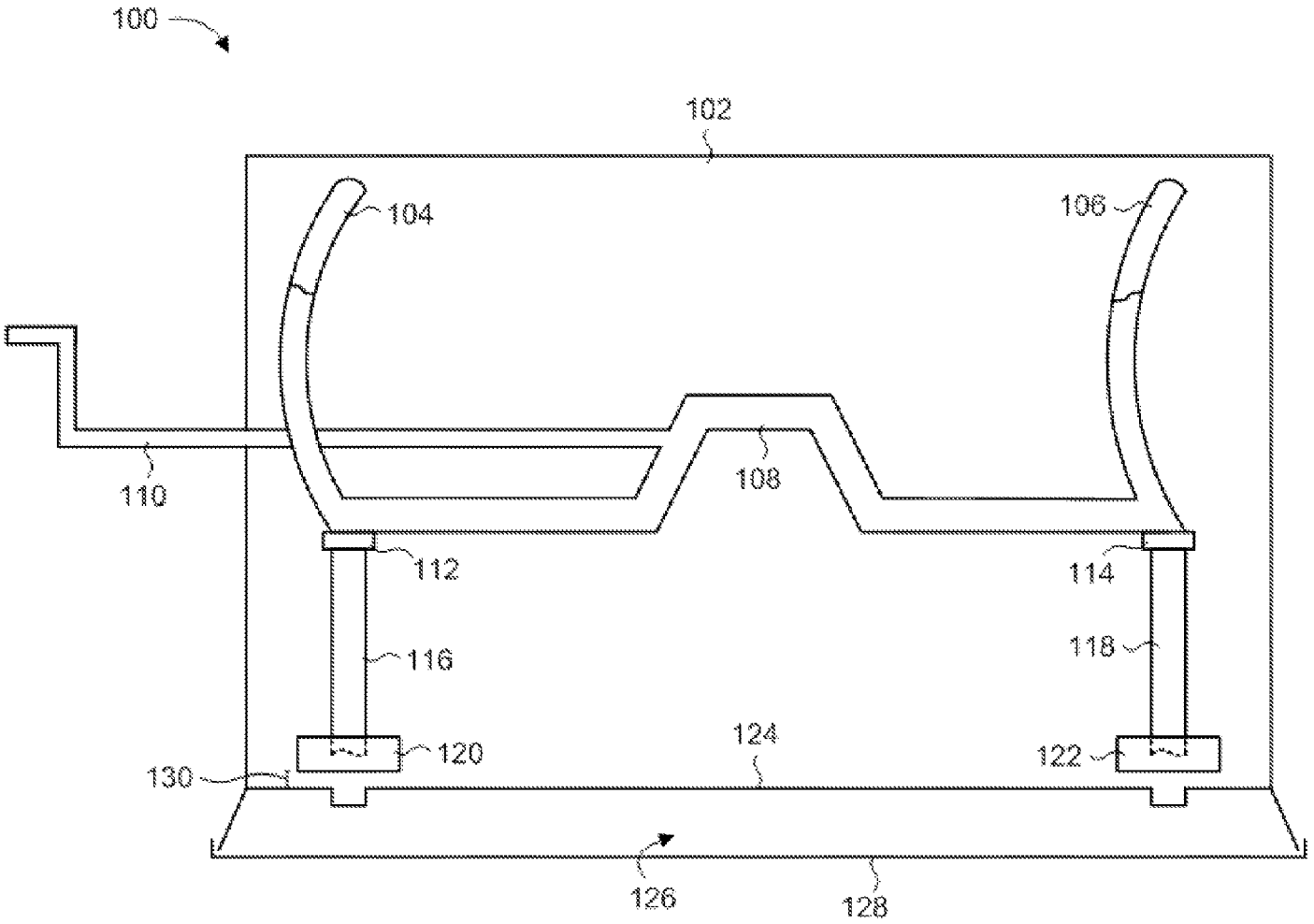
FIG. 1A is a top view schematic illustration of a combination binding and perforation assembly in a lowered lever position, constructed and operative in accordance with an embodiment of the disclosed technique.
Figure 1B:
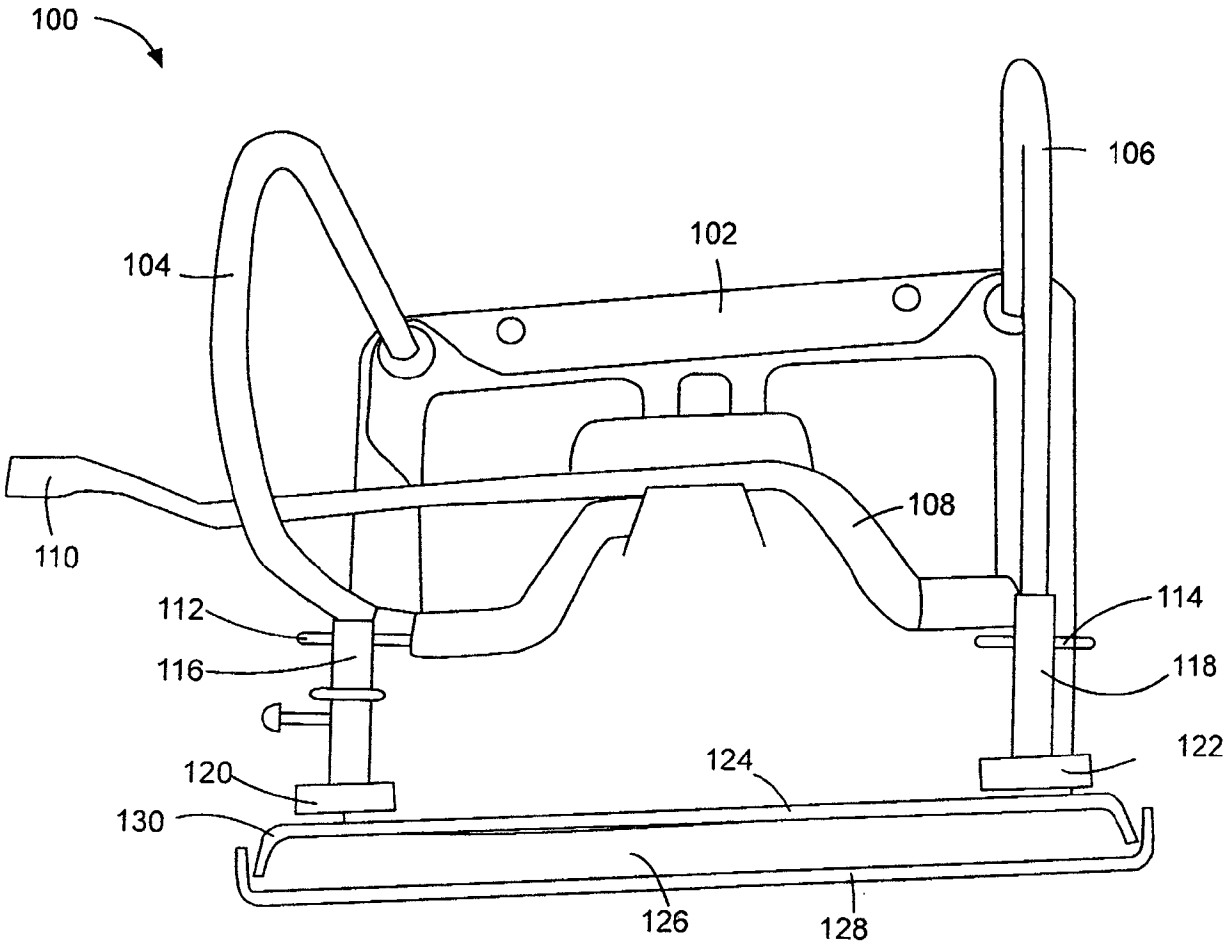
FIG. 1B is a top view image of a combination binding and perforation assembly in a lowered lever position, constructed and operative in accordance with an embodiment of the disclosed technique.
Figure 2A:
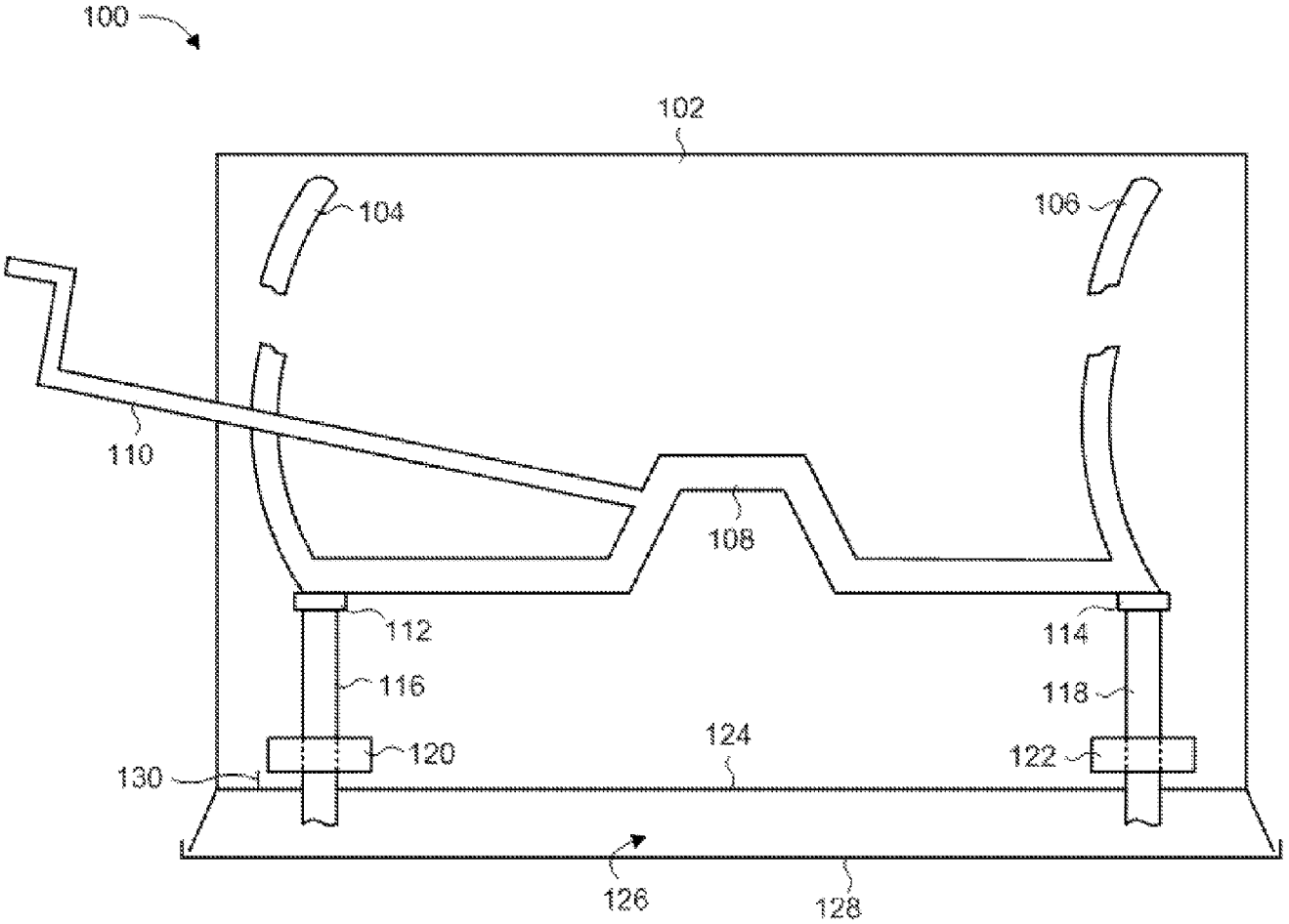
FIG. 2A is a top view schematic illustration of the combination binding and perforation assembly of FIG. 1A in a raised lever position, in accordance with an embodiment of the disclosed technique.
Figure 2B:
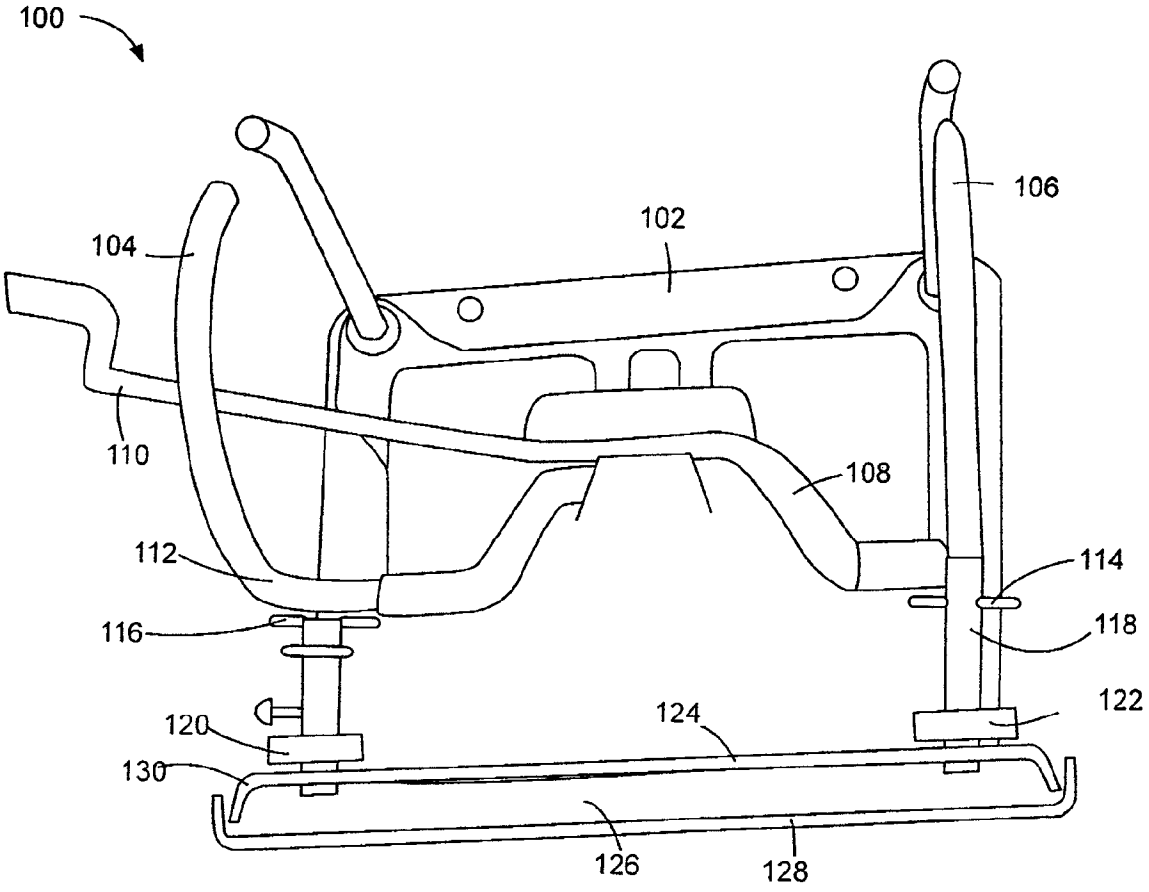
FIG. 2B is a top view image of the combination binding and perforation assembly of FIG. 1B in a raised lever position, in accordance with an embodiment of the disclosed technique.
Figure 3A:
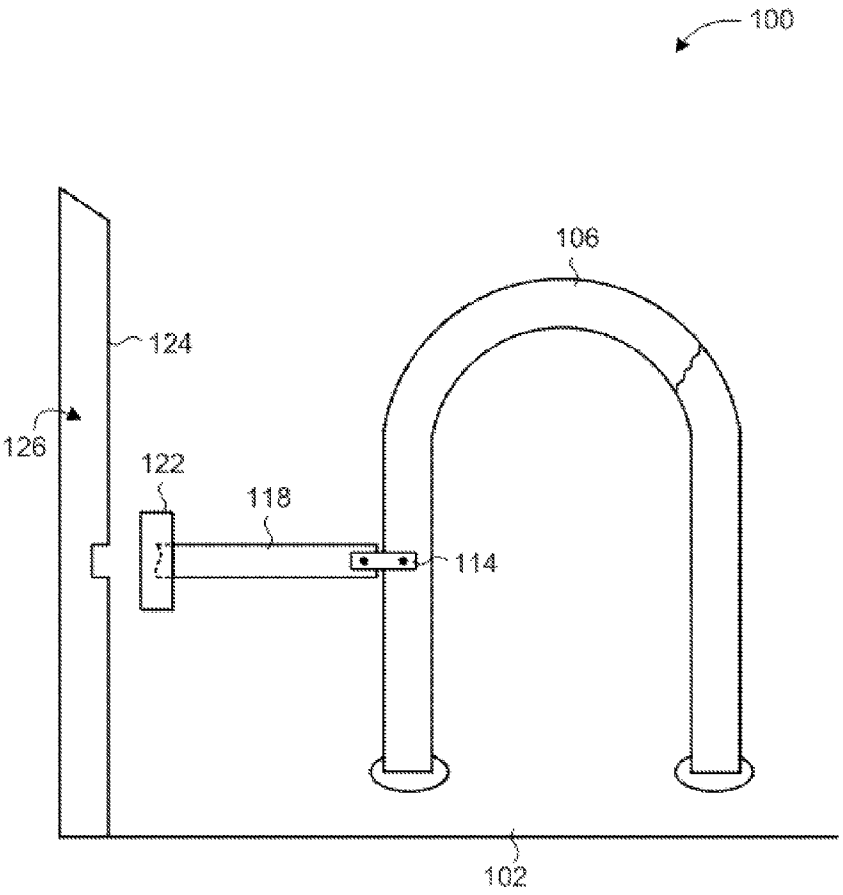
FIG. 3A is a side view schematic illustration of the combination binding and perforation assembly of FIG. 1A in a lowered lever position.
Figure 3B:
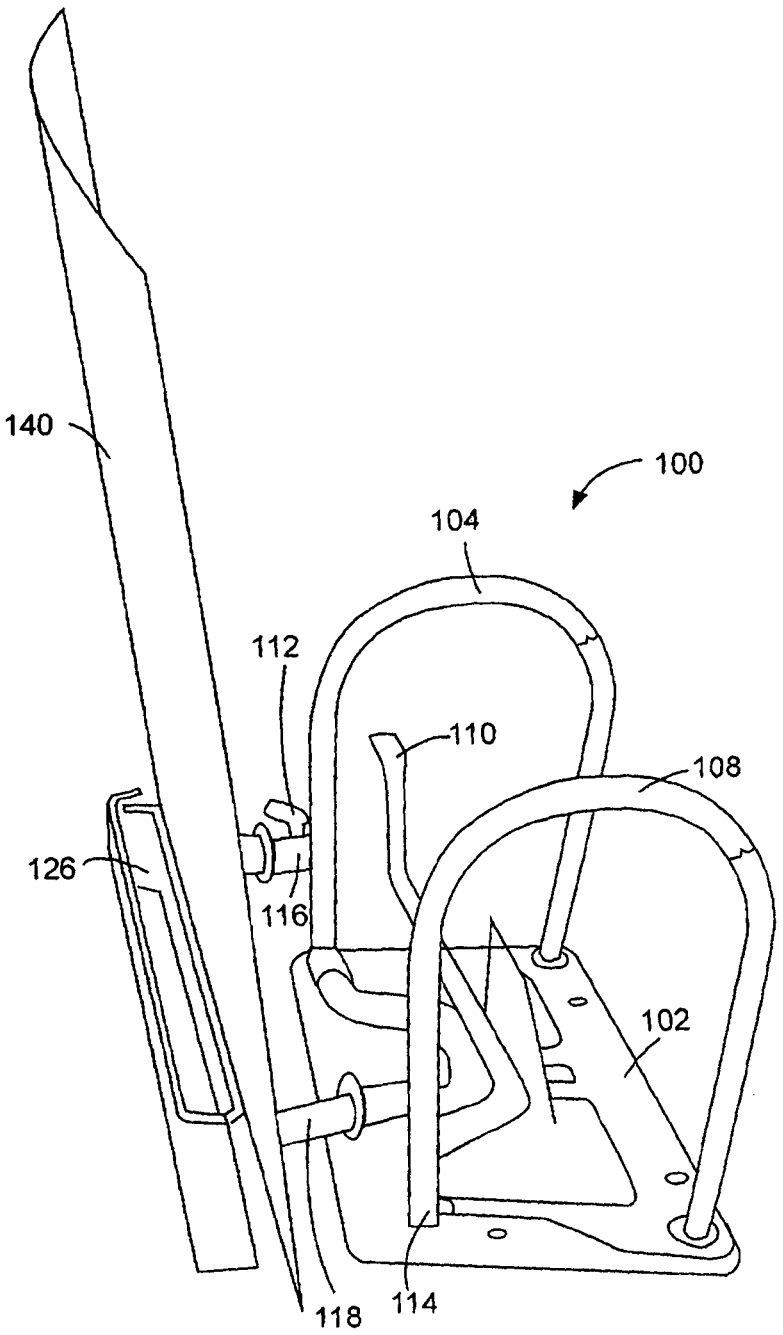
FIG. 3B is a side perspective view image of the combination binding and perforation assembly of FIG. 1B in a lowered lever position and with a sheet of paper inserted into the perforation slot.
Figure 4A:
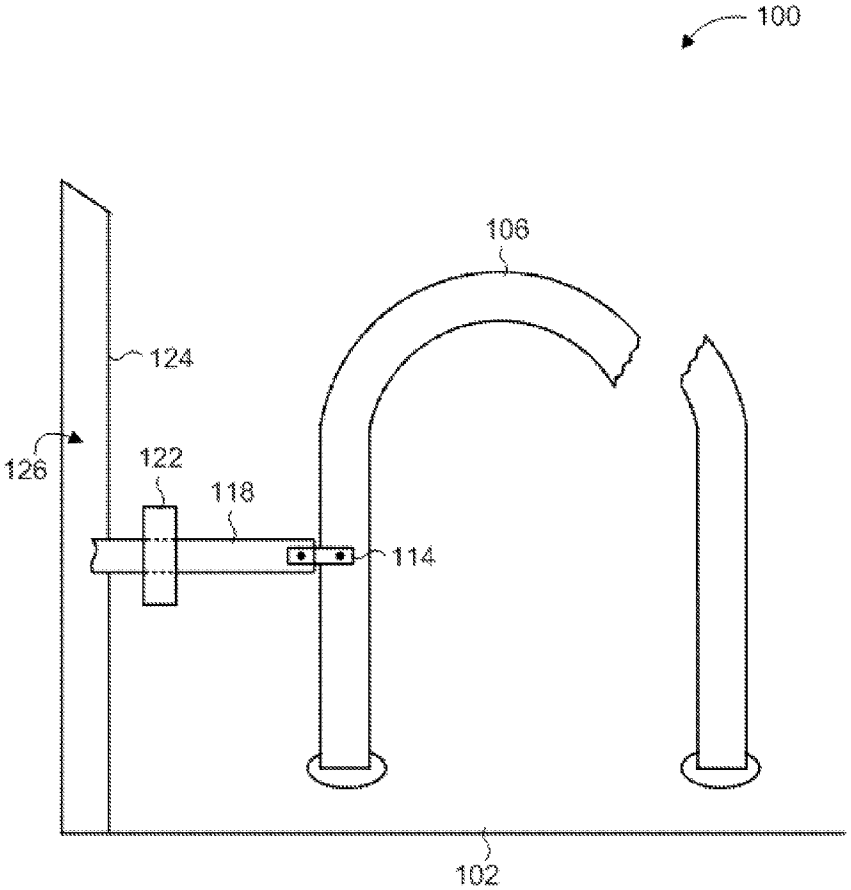
FIG. 4A is a side view schematic illustration of the combination binding and perforation assembly of FIG. 2A in a raised lever position.
Figure 4B:
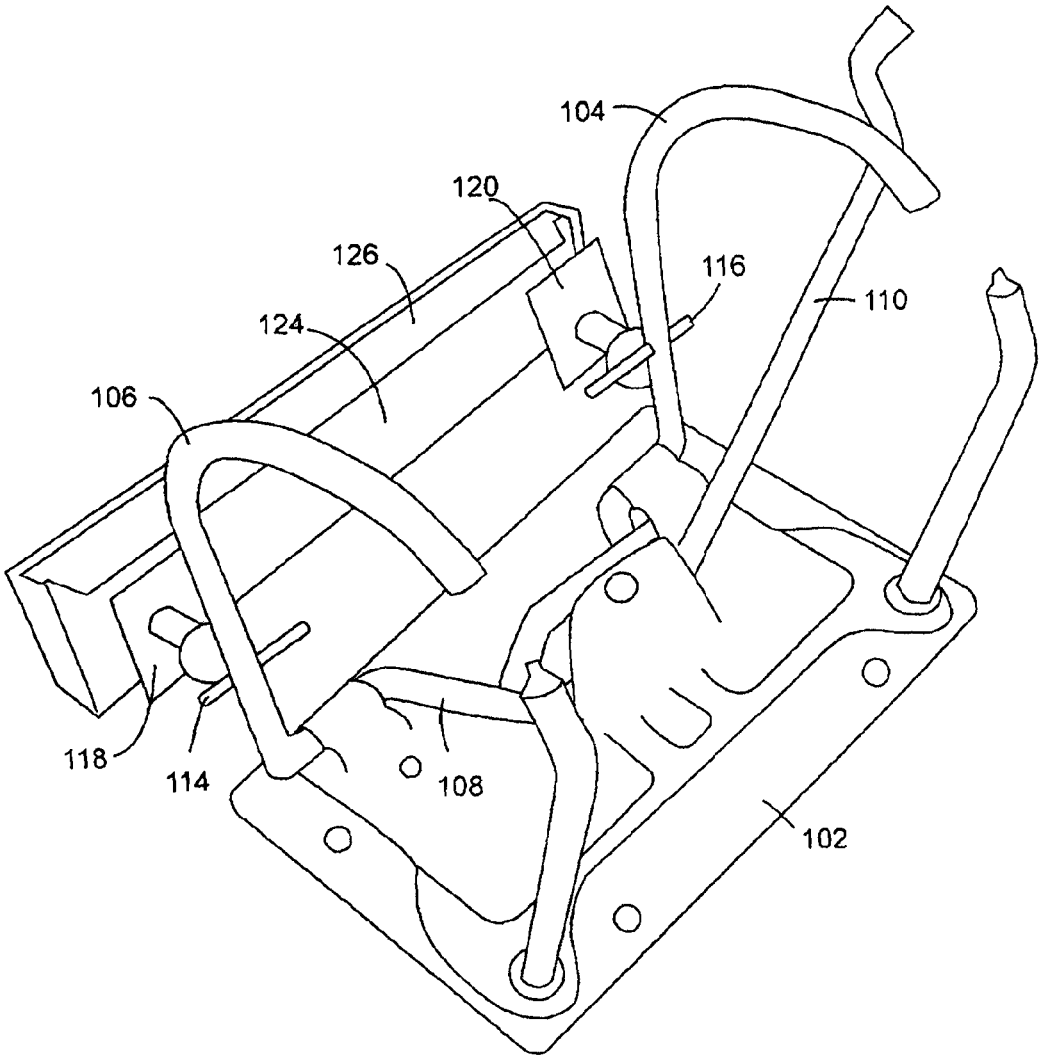
FIG. 4B is a top perspective view image of the combination binding and perforation assembly of FIG. 2B in a raised lever position.

Reference is now made to FIGS. 1A, 1B, 2A, 2B, 3A, 3B, 4A and 4B. FIG. 1A is a top view schematic illustration of a combination binding and perforation assembly, generally referenced 100, in a lowered lever position, constructed and operative in accordance with an embodiment of the disclosed technique. FIG. 1B is a top view of image of a combination binding and perforation assembly, generally referenced 100, in a lowered lever position, constructed and operative in accordance with an embodiment of the disclosed technique. FIG. 2A is a top view schematic illustration of the combination binding and perforation assembly (100) of FIG. 1A in a raised lever position, in accordance with an embodiment of the disclosed technique. FIG. 2B is a top view image of the combination binding and perforation assembly (100) of FIG. 1B in a raised lever position, in accordance with an embodiment of the disclosed technique. FIG. 3A is a side view schematic illustration of the combination binding and perforation assembly (100) of FIG. 1A in a lowered lever position. FIG. 3B is a side perspective view image of the combination binding and perforation assembly (100) of FIG. 1B in a lowered lever position and with a sheet of paper inserted into the perforation slot. FIG. 4A is a side view schematic illustration of the combination binding and perforation assembly (100) of FIG. 2A in a raised lever position. FIG. 4B is a top perspective view image of the combination binding and perforation assembly (100) of FIG. 2B in a raised lever position. Assembly 100 includes a base portion 102, a pair of binding rings 104 and 106, a bar 108, a lever 110, a pair of connectors 112 and 114, a pair of perforating rods 116 and 118, a pair of guiding plates 120 and 122, a wall portion 124, a container 126, and a perforation slot 130.

Base portion 102 is flat and substantially rectangular-shaped. Wall portion 124 is also flat and substantially rectangular-shaped, and is disposed at one end of base portion 102 in a vertical alignment with respect to base portion 102, such that the surface of wall portion 124 is substantially perpendicular to the surface of base portion 102. Base portion 102 and wall portion 124 may generally be of any suitable size or shape.

Binding rings 104 and 106 protrude outwards from the surface of base portion 102, such that a first binding ring 104 is disposed on one side of base portion 102 (e.g., at the left end thereof) and a second binding ring 106 is disposed on the other side of base portion 102 (e.g., at the right end thereof). Each binding ring 104, 106 is affixed to base portion 102 at two separate connection points via a vertical arm portion at each of the two ends of the binding ring 104, 106. The two vertical arm portions are joined via an intermediate arced portion, so that binding rings 104 and 106 resemble an inverted U-shape. Binding rings 104 and 106 are also coupled to bar 108, which is disposed laterally across base portion 102. Binding rings 104 and 106 may generally be of any suitable size or shape, and may be affixed to base portion 102 via an alternative configuration.

Perforating rods 116 and 118 are short bladed cylinders. Each of perforating rods 116 and 118 is disposed adjacent to and coupled with a respective one of binding rings 104, 106, via a respective one of connectors 112, 114. In particular, a left perforating rod 116 is coupled with a left binding ring 104 via connector 112 on the left side of base portion 102, while a right perforating rod 118 is coupled with a right binding ring 106 via connector 114 on the right side of base portion 102. The perforating rods 116, 118 are disposed in a horizontal alignment with respect to base portion 102 (i.e., the longitudinal axis of each perforating rod 116, 118 is parallel to the surface of base portion 102). One end of each perforating rod 116, 118 (i.e., the distal end with respect to binding ring 104, 106) is bladed or sharpened, to enable cutting through a portion of a paper sheet. The diameter of perforating rods 116, 118 is at least as large as, and generally approximately the same size as, the diameter of binding rings 104, 106. Perforating rods 116 and 118 may generally be of any suitable size or shape, and may be disposed in assembly 100 in any suitable configuration.

Connectors 112 and 114 include components for joining the respective perforating rods 116, 118 with the respective binding rings 104, 106. For example, connector 112 may be embodied by a circular link that is inserted through an aperture in perforating rod 112 and also through an aperture in binding ring 104 (FIGS. 3A and 4A), thereby fixedly coupling perforating rod 112 with binding ring 104. In general, the perforating rods 116, 118 may be coupled with respective binding rings 104, 106 via any suitable coupling arrangement.

Guiding plates 120 and 122 are small and square shaped with a central aperture corresponding to at least the diameter of perforating rods 116 and 118. Each of guiding plates 120 and 122 is disposed around and at one end of a respective one of perforating rods 116, 118, such that first perforating rod 116 is disposed through the central aperture of a first guiding plate 120 on one side of base portion 102 (e.g., at the left end thereof) and a second perforating rod 118 is disposed through the central aperture of a second guiding plate 122 on the other side of base portion 102 (e.g., at the right end thereof). Guiding plates 120 and 122 are disposed at the bladed end of respective perforating rods 116, 118 (i.e., the end nearest to wall portion 124). Guiding plates 120, 122 are aligned such that the surface of guiding plates 120, 122 are substantially perpendicular to the surface of base portion 102 (i.e., and therefore substantially parallel to the surface of wall portion 124).

Perforation slot 130 is defined by the gap between guiding plates 120, 122 and wall portion 124, the gap being wide enough to accommodate at least one sheet of paper to be perforated. Container 126 is defined by wall portion 124 on one side and an addition container wall portion 128 on an opposite side, forming an enclosed compartment. Container 126 is operative for collecting the perforation remains produced after a paper sheet has been perforated. A pair of holes is disposed in the surface of wall portion 124, at respective locations and having respective diameters corresponding to each of perforating rods 116, 118, such that the perforating rods 116, 118 propel the perforated paper remains into container 126 upon perforation. Container 126 preferably includes a removable cover (not shown in the Figures), which can be removed to allow for the intermittent disposal of the collected perforation remains, and can then be placed back over container 126. Container 126 may be detachable from assembly 100, such that, for example, container wall portion 128 can be detached from wall portion 124 and subsequently reattached to wall portion 124 (e.g., to enable convenient disposal of the collected perforation remains).

Lever 110 includes an elongated thin cylindrical portion joined to a short handle portion at one end. The thin cylindrical portion of lever 110 is disposed over base portion 102 (e.g., lengthwise across the length of base portion 102), and the short handle portion of lever 110 protrudes outwards beyond base portion 102 (i.e., to one side thereof). The other end of the thin cylindrical portion of lever 110 is coupled with bar 108 (e.g., near the middle section of bar 108). Lever 110 may generally be of any suitable size or shape, and may be disposed in assembly 100 in any suitable configuration.

The components of assembly 100 (i.e., base portion 102, binding rings 104 and 106, bar 108, lever 110, connectors 112 and 114, perforating rods 116 and 118, guiding plates 120 and 122, wall portion 124, and container wall portion 128) are typically made of metal, such as stainless steel, however any one of these components may alternatively be composed from any other suitable material (e.g., plastic).

When lever 110 is in a lowered position (FIGS. 1A, 1B, 3A and 3B), binding rings 104, 106 are closed and perforating rods 116, 118 are retracted from perforation slot 130. When lever 110 is raised from a lowered position (FIGS. 2A, 2B, 4A and 4B), such as by a user manually lifting the handle portion of lever 110, then binding rings 104, 106 open (i.e., one portion of the binding ring separates from another portion to provide an opening therebetween) and perforating rods 116, 118 advance toward perforation slot 130 until the bladed ends of perforating rods 116, 118 pass through respective sections in wall portion 124 (i.e., through the corresponding holes disposed in wall portion 124). If a paper sheet 140 is inserted into perforation slot 130 (FIG. 3B), and then lever 110 is raised, perforating rods 116, 118 will perforate the inserted sheet 140 to produce two perforations or holes along an edge of sheet 140. The two perforations are aligned with the positions of binding rings 104, 106 (i.e., the distance between the two perforations corresponds to the distance between binding ring 104 and binding ring 106), enabling the perforated paper sheet 140 to be inserted into binding rings 104, 106 through the respective perforations, for retaining the sheet in an organized manner. The perforation remains that are produced (i.e., two circular pieces of paper corresponding to the perforated section of the paper sheet) are gathered into container 126, from which they may be disposed at a later time. Sheet 140 may be manually held and supported during perforation (i.e., while an end of sheet is inserted into perforation slot 130), to ensure that sheet 140 is maintained in a steady position during the perforation. For example, a user may use one hand to hold a top portion of sheet 140 to keep sheet 140 steady, while using another hand to raise lever 110 to implement the perforation of sheet 140. When lever 110 is lowered from a raised position, such as by a user manually lowering the handle portion of lever 110, then binding rings 104, 106 close (i.e., the separated portions of the binding ring link together), thereby retaining any sheets that have been inserted through binding rings 104, 106, while perforating rods 116, 118 retract back from perforation slot 130. Guiding plates 120, 122 serve to guide and support the respective perforating rods 116, 118 as they advance to or retract from perforation slot 130.

It is appreciated that assembly 100 may be adapted to support perforation of multiple paper sheets simultaneously, i.e., such that the gap width of perforation slot 130 and the force applied by perforating rods 116, 118 is sufficient to enable the simultaneous perforation of multiple sheets. Assembly 100 may be adapted to retain any number of paper sheets via binding rings 104, 106. Additionally, assembly 100 may perforate or bind sheets of any suitable size (i.e., at least wide enough to accommodate the distance between perforating rods 116, 118 and/or the distance between binding rings 104, 106), sheets with varying degrees of thickness (e.g., differing grades of paper), and sheets made from alternative materials (e.g., plastic sheets). Assembly 100 may generally include more than two binding rings/perforating rods, as long as there are an equal number of binding rings and perforating rods (e.g., assembly 100 may include three binding rings and three perforating rods), which are typically uniformly spaced apart from one another. Assembly 100 may alternatively include a different type of binding mechanism other than binding rings 104, 106, such as latches, arches, clamps, and the like.

The invention claimed is:

1. A combination binding and perforation assembly comprising:

a base portion;

a plurality of binding rings, protruding from said base portion, said binding rings operative to bind together a plurality of perforated paper sheets;

a plurality of perforating rods, each of said perforating rods disposed adjacent to and coupled with a respective one of said binding rings via a respective connector, said perforating rods operative to perforate paper sheets;

a plurality of guiding plates, each of said guiding plates disposed around and at an end of a respective one of said perforating rods where the surface of said guiding plates is substantially perpendicular to the surface of said base portion, said guiding plates operative to guide and support said perforating rods;

a wall portion, disposed at an edge of said base portion such that the surface of said wall portion is substantially perpendicular to the surface of said base portion and substantially parallel to the surfaces of said guiding plates;

a perforation slot, defined by a gap between said guiding plates and said wall portion, at least one paper sheet being insertable into said perforation slot; and a lever, coupled with said binding rings, such that when said lever is raised, said binding rings open and said perforating rods advance toward said perforation slot in order to perforate at least one paper sheet inserted in said perforation slot, and when said lever is lowered, said binding rings close and said perforating rods retract from said perforation slot.

2. The assembly of claim 1, wherein the distance between the perforations produced in said paper sheet after being perforated, substantially corresponds to the distance between said binding rings, enabling said perforated paper sheet to be inserted into said binding rings through said perforations.

3. The assembly of claim 1, further comprising a bar, coupled with said binding rings and with said lever, said bar disposed laterally across said base portion.

4. The assembly of claim 1, wherein said connector comprises a circular link inserted through an aperture in a respective one of said perforating rods and inserted through an aperture in a respective one of said binding rings.

5. The assembly of claim 1, further comprising a container, defined by said wall portion and a container wall portion on an opposite side forming an enclosed compartment, said container operative for collecting the perforation remains produced after said paper sheet is perforated.

6. The assembly of claim 5, wherein said wall portion comprises a plurality of holes opposite each of said perforating rods, such that said perforating rods propel said perforation remains into said container upon perforation.

7. The assembly of claim 5, further comprising a container cover, which is positionable onto and removable from said container.

8. The assembly of claim 5, wherein said container is detachable from said wall portion.

9. The assembly of claim 1, comprising two of said binding rings, two of said perforating rods, and two of said guiding plates.

10. The assembly of claim 1, comprising three of said binding rings, three of said perforating rods, and three of said guiding plates.

* * * * *